US006106061A

United States Patent [19]

Caruso et al.

[11] Patent Number: 6,106,061

[45] Date of Patent: Aug. 22, 2000

[54] STACKABLE LEG-OVER-LEG GANGING CHAIR

[75] Inventors: Jerome C. Caruso, Lake Forest; Steven J. Caruso, Antioch, both of Ill.

[73] Assignee: Shelby Williams Industries, Inc., Morristown, Tenn.

[21] Appl. No.: 09/354,241

[22] Filed: Jul. 16, 1999

Related U.S. Application Data

[63] Continuation-in-part of application No. 29/090,818, Jul. 16, 1998, Pat. No. Des. 413,207.

[51] Int. Cl.[7] ..... A47C 1/124; A47C 3/04

[52] U.S. Cl. ..... 297/239; 297/248

[58] Field of Search ..... 297/239, 248, 297/448.1

[56] References Cited

U.S. PATENT DOCUMENTS

| | | | |
|---|---|---|---|
| D. 279,438 | 7/1985 | Gerner . | |
| 3,141,699 | 7/1964 | Stafford | 297/239 |
| 3,224,810 | 12/1965 | Jenniges et al. | 297/239 X |
| 3,827,749 | 8/1974 | Johnson et al. . | |
| 5,154,474 | 10/1992 | Desanta | 297/239 |
| 5,649,742 | 7/1997 | Liu | 297/448.1 X |

*Primary Examiner*—Peter R. Brown
*Attorney, Agent, or Firm*—Pitts & Brittian, P.C.

[57] ABSTRACT

A vertical stacking leg-over-leg ganged chair is attachable side-by-side and includes an upper frame adapted to receive and support a seating platform, and a lower frame supporting the upper frame, and a backrest for supporting a user seated in the chair. The ganged chair includes a front pair of legs angled frontward, and a rear pair of legs angled rearward, each pair connected underneath the lower frame. The right legs are connected to a right frame member, and the left legs to a left frame member, with the left frame member being of a lesser length than the right frame member. In a side-by-side ganged setup, the wider spaced apart right legs of one ganged chair fit over the left legs of a second like chair, forming a single width leg unit on either side of the ganged chairs. Each upper portion of the left legs includes an elongated slot that accepts an elongated lug on the upper portion of each right leg, for connective support when chairs are attached horizontally. The configuration of legs, the angles of the legs, and the rearward angle of the backrest, allow the ganged chair to be stacked vertically for ease of transfer. The leg-over-leg structure allows connection side-to-side, providing a lesser overall width of chairs when in the ganged configuration.

20 Claims, 12 Drawing Sheets

STACKABLE LEG-OVER-LEG GANGING CHAIR

This application is a continuation-in-part of earlier filed U.S. Design application, Ser. No. 29/090,818, filed Jul. 16, 1998 now U.S. Design Pat. No. D413,207 issued Aug. 31, 1999.

FIELD OF INVENTION

The present invention relates generally to the field of movable seating, and more particularly to chairs that are stackable during storage, and are connectable side-to-side during use.

BACKGROUND OF INVENTION

In the field of movable seating, chair structures may be designed to be attached side-to-side during use, and may be stackable for storage. It is a preference in the field that the chair structures be easily connectable and disconnectable in side-by-side relationships (i.e. ganged), and the chair structures be stackable when disconnected for ease of movement from one location to another for use, and for storage.

Typical of the art are those devices disclosed in the following U.S. Patents. In U.S. Pat. No. 3,827,749, to Johnson et al., a chair structure is disclosed that may be stacked vertically, and may be connectable side-by-side, with a right-side leg member of a first chair resting below and in contact with a left-side leg member of a second chair. The left side leg of each chair includes a keeper member mounted on an exterior side of the upper portion of each left leg in the form of a vertical flange that engages the leg member of the adjacent chair to allow horizontal ganging of like chair structures. The ganging components of adjacent like chair structures are bulky leg members having rectangular cross-sections.

In U.S. Pat. No. Des. 279,438, to Gerner, an ornamental design is disclosed for a tubular chair having inverted U-shaped leg members and seat and back side frame members connected to the tubular chair frame. The design patent does not disclose whether the tubular chair is stackable or connectable in a gang horizontal orientation with like chair structures.

Accordingly, there is a need for an improved chair structure that, when stacked vertically, forms a sturdy and easily movable stack of chairs, and when unstacked and connected to similar chair structures, forms a space-efficient assembly of chairs in ganged horizontal orientation which are easily connectable and disconnectable.

Therefore, it is an object of the present invention to provide a chair that is stackable in a generally vertical direction upon other chairs with similar structure.

It is a further object of the present invention to provide a chair structure that is connectable side-by-side in a horizontal direction with other chairs with similar structure.

It is an additional object of the present invention to provide a ganging chair structure having a leg structure that is connectable with an opposite leg of a chair of similar structure to provide a row of chairs that are space efficient and firmly attached to each other.

SUMMARY OF INVENTION

In accordance with the present invention, an improved chair structure is disclosed that provides a vertically stackable, and horizontally ganging chair for supporting a user seated in the chair, including an upper frame adapted to receive and support a generally planar seat and a backrest. As desired, the upper frame may include a detachable resilient seat cushion and a detachable resilient backrest. The chair further includes a lower frame comprising first and second leg members depending from a first side of the lower frame, and third and fourth leg members depending from a second side of the lower frame, each of the leg members having an upper and a lower end adapted to engage the supporting surface for the chair. The first and second leg members include a first connector member extending between and fixedly interconnecting the upper ends of the first and second leg members one to another. The third and fourth leg members include a second connector member extending between and fixedly interconnecting the upper ends of the third and fourth leg members one to another. A front cross-member connects the front first leg member and the front third leg member at an upper portion of each front leg member, the front cross-member being recessed under the front of the upper frame. A rear cross-member connects a rear second leg member and a rear fourth leg member at an upper portion of each rear leg member.

The first and second connector members are disposed inwardly of the lower frame whereby the upper ends of each of the leg members which are connected to a respective connector member are disposed outwardly of the respective connector member. In accordance with one aspect of the present invention, the first connector member is shorter in length than the second connector member, whereby the upper ends of the first and second leg members are disposed apart from one another by a distance smaller than the spaced apart distance of the upper ends of the third and fourth leg members, whereby the leg members of a first chair will receive thereon, in leg-over-leg relationship, corresponding leg members of a further chair for stacking of the first and further chairs. Each of the upper ends of the first and second leg members includes respective outer surfaces and a slot defined in each of the outer surfaces, each of the slots extending along a portion of the length dimension of its respective leg member, with one end of each slot opening outwardly of the upper end of the respective first and second leg members. Each of the upper ends of the third and fourth leg members includes respective inner surfaces which face one another, with an elongated lug member projecting from the inner surface of the third leg member and an elongated lug member projecting from the inner surface of the fourth leg member, the lugs facing one another across the space between the upper ends of each respective third and fourth leg members. The lugs of the third and fourth leg members of a first chair are receivable within respective slots of the first and second leg members of a further chair. The first and second leg members of the further chair are disposed under and in leg-over-leg relationship to the third and fourth leg members of the first chair to thereby secure the first and further chairs in ganged side-by-side relationship. The combination of elements of the improved ganging chair structure provides a leg-over-leg chair structure that is easily and quickly connectable and disconnectable, occupies less floor space when connected side-by-side with similar chairs, and provides increased seating capacity within meeting facilities of limited space.

BRIEF DESCRIPTION OF DRAWINGS

The above mentioned objects and advantages of the present invention are readily apparent from the description contained herein, and by reference to the claims, read together with the drawings in which:

DETAILED DESCRIPTION OF INVENTION

Figure 1:
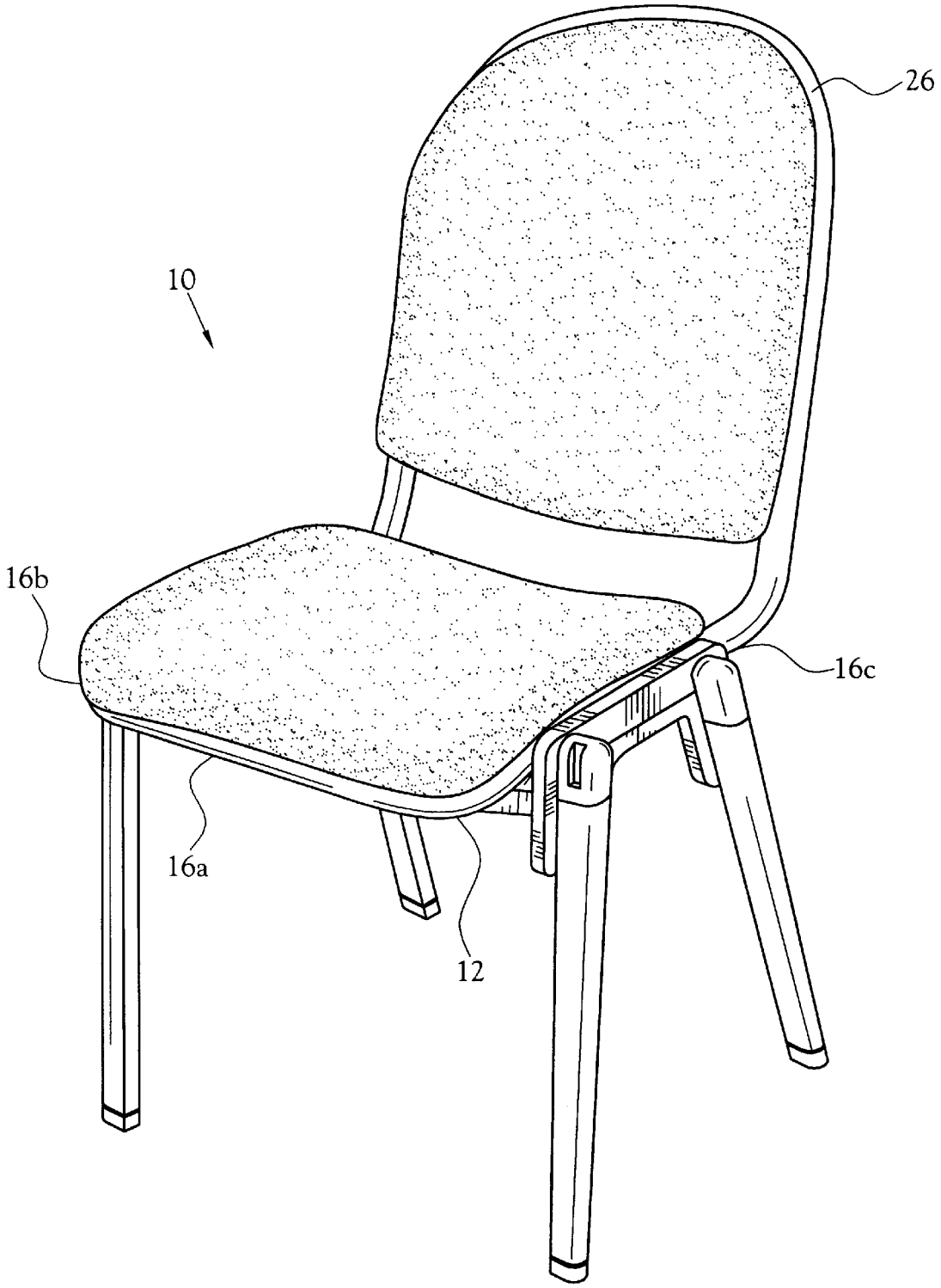
FIG. 1 is a perspective view of one embodiment of a stackable leg-over-leg ganging chair of the present invention.
Figure 2:
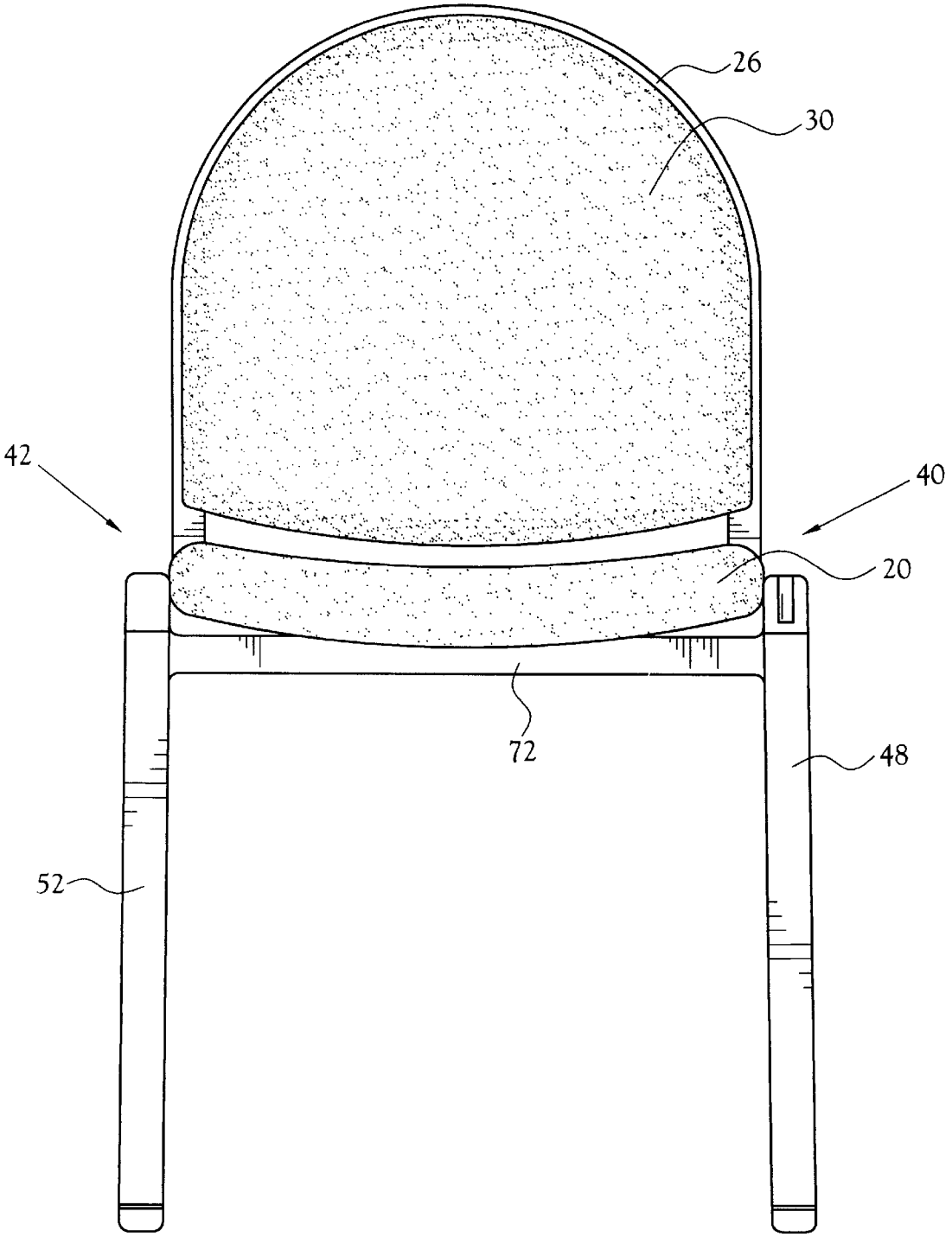
FIG. 2 is a front view of the ganging chair of FIG. 1, illustrating a front-facing elongated slot in an upper portion of the left front chair leg.
Figure 3:
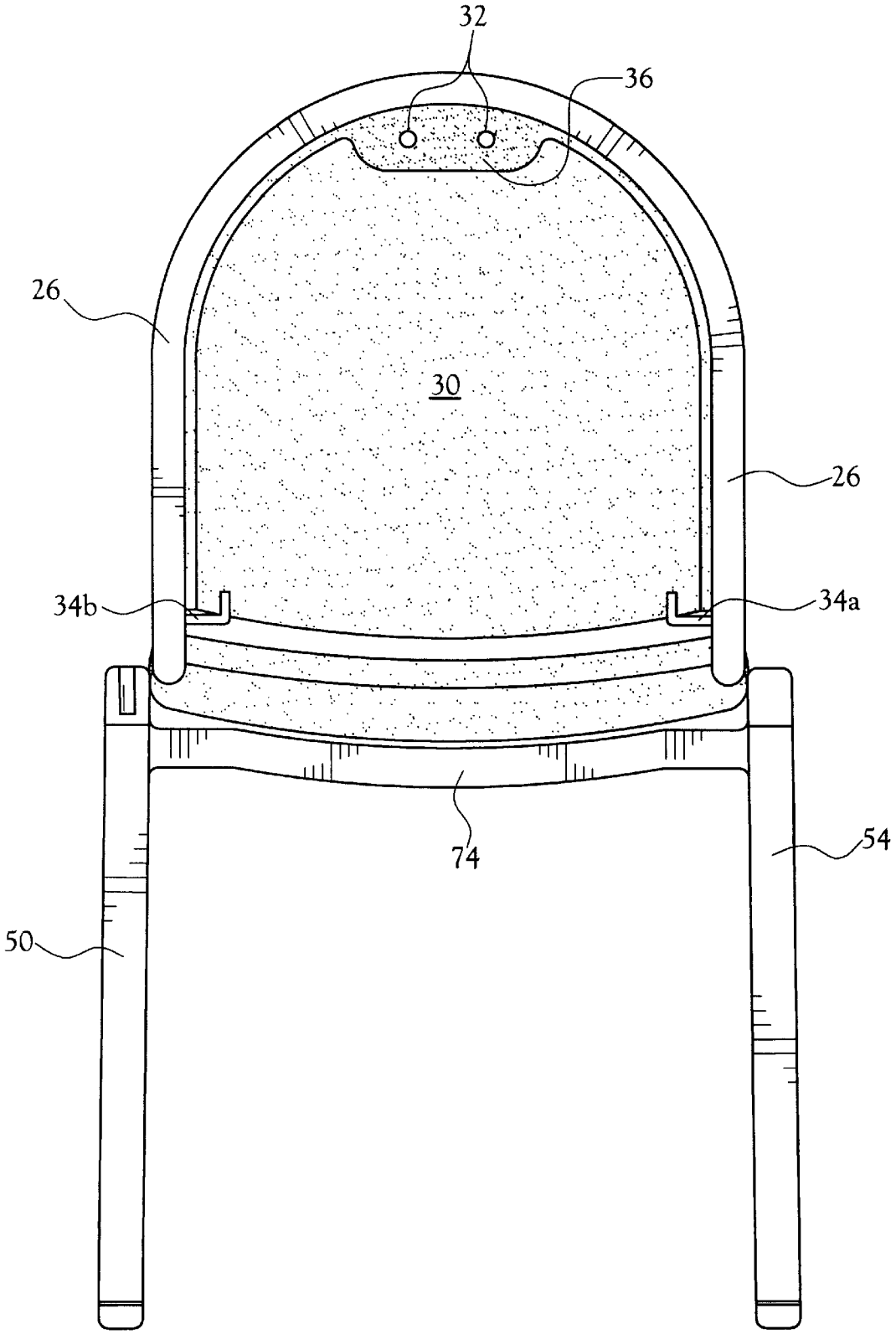
FIG. 3 is a rear view of the ganging chair of FIG. 1 illustrating a rear-facing elongated slot in an upper portion of the left rear chair leg.
Figure 4:
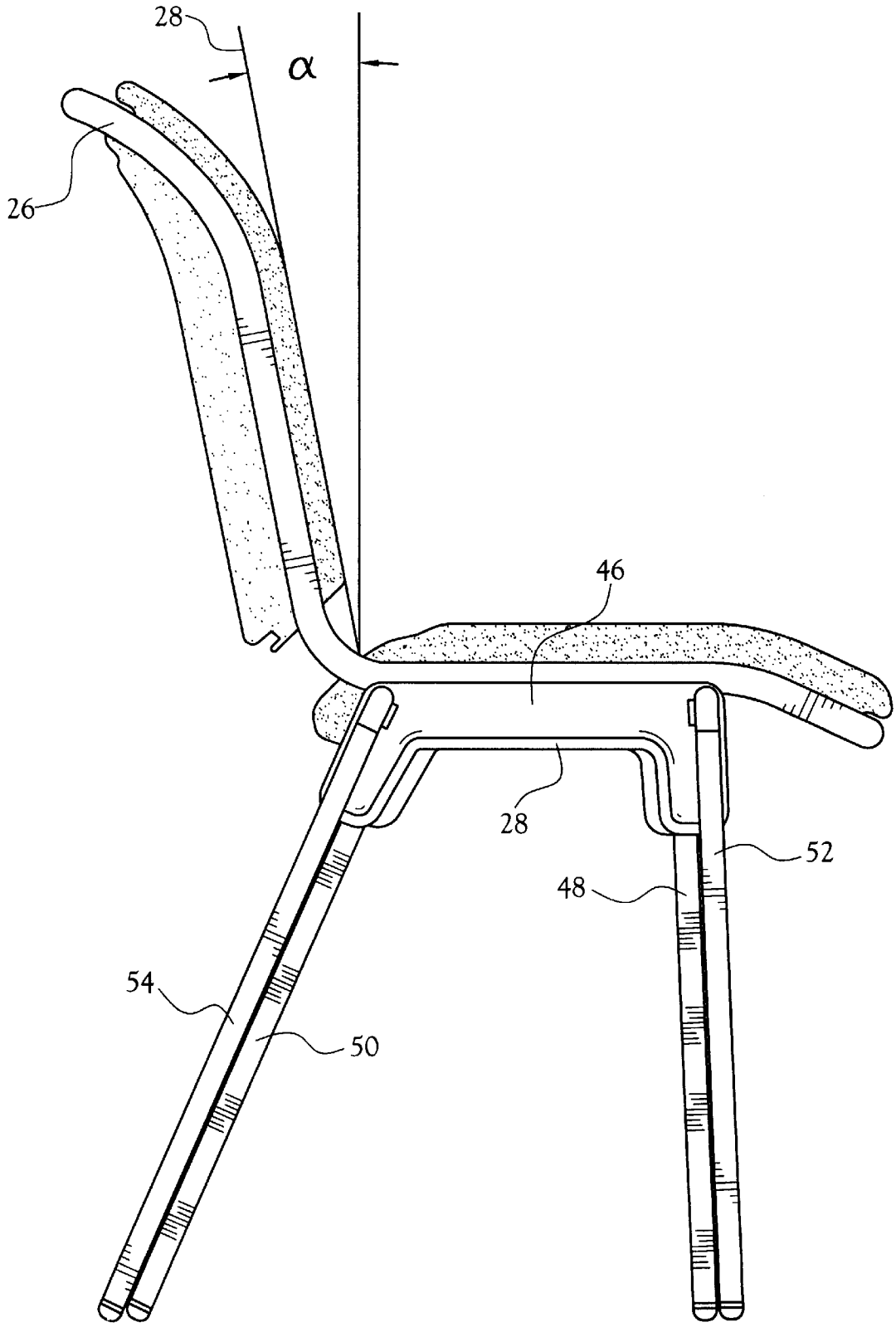
FIG. 4 is a right side view of the ganging chair of FIG. 1 illustrating a set of elongated lugs, one facing backward and positioned on an upper portion of the right front chair leg, and one facing forward and positioned on an upper portion of the right rear chair leg.

A stachable leg-over-leg ganged chair incorporating various features of the present invention is illustrated generally at 10 in FIGS. 1–12. The stackable chair 10, is designed for vertical stacking (see FIG. 10), and for horizontal side-by-side connecting (see FIGS. 6 and 11), on a supporting surface for the chairs.

From the foregoing description, it will be recognized that the stackable leg-over-leg ganged chair 10 of the present invention offers advantages by providing an attachment mechanism for a plurality of leg-over-leg ganged chairs 10 of like design to be attached side-by-side within less time, with less floor space width for a given number of ganged chairs, and with increased seating capacity for each assembled horizontal row of ganged chairs 10.

One embodiment of the leg-over-leg ganged chair 10 of the present invention includes an upper frame 12 (see FIG. 1), suitably formed of generally cylindrical tubes 14 (see FIG. 7*b*) that define a generally rectangular upper frame base portion 16 (see FIG. 7*a*), having at least three sides of tubes having a front base side 16*a,* a right base side 16*b,* and a left base side 16*c*. The rear portion of each of the right base side 16*b* and the left base side 16*c* curve upwards to form the backrest 26 of the chair.

The front base side 16*a,* right base side 16*b,* left base side 16*c,* of the upper frame 12 form a supporting frame adapted to receive and support a seat platform 18, and a backrest 26. The seat platform 18 may include a resilient seat cushion 20 that is detachably connectable to the seat platform 18 by four screw connectors (not shown), to four connector brackets 22*a, b, c, d* that are bonded to the underside of the right base side 16*b,* and a left base side 16*c* (see FIG. 7*b* and 7*c,* for example). The screw connectors when removed, allow for the seat cushion 20 to be changed quickly for another cushion of similar or different materials or patterns, allowing use of the ganged chair 10 in a multitude of casual, business, or formal settings.

The backrest 26 of the chair frame 12 curves upward from the rearward end of right base side 16*b,* and a left base side 16*c,* forming a support frame for attachment of a resilient back cushion 30, for example. The upper section of the backrest 26 is angled backward, forming a slight angle ( ) from the vertical (see FIG. 4), allowing for a natural back rest for the normal posture of a sitting person. In the depicted embodiment of FIGS. 2 and 3, the back cushion 30 is attachable to the front surfaces of the backrest 26 by placing the back cushion 30 downward and onto two prong supports 34*a, b,* that are connected to the right and left tubular side sections of the backrest 26 (see FIG. 3). Once the cushion 30 is placed on the prong supports 34*a, b,* the upper portion of the back cushion 30 is attachable to the upper bracket 36 that is connected to the backrest 26. The back cushion 30 can be changed quickly for another back cushion as desired, with the cushion 30 encircled by backrest 26 (see FIG. 2).

The chair of the present invention further includes a lower frame which includes first and second sides supporting the upper frame above a supporting surface for the chair. The lower frame includes a first side, or left side 40, and a first connector member, also identified as the left side frame member 44, and a second side, or right side 42, and a second connector member, also identified as the right side frame member 46, that are substantially parallel to each other, and parallel to the left side 40 and right side 42 respectfully of the base portion 16. The left side frame member 44 connects between the upper portion of the first leg member, or left front leg member 48 and to the upper portion of the second leg member, or left rear leg member 50. Each of the first leg 48 and second leg 50 members have a lower end adapted to engage the supporting surface for the chair, and an upper end connected to the left side frame member 44.

The second side connector member, also identified as the right side frame member 46, connects between, and to an upper inside portion of the third leg connector, or right front leg member 52, and the fourth leg connector, or right rear leg member 54. Each side frame connector member can include a plastic or rubber edge cover 28 on the lower surface of each frame member 44, 46 for protection of the lower surface during vertical stacking of the chair frames one on another. Each of the third leg 52 and fourth leg 54 members have a lower end adapted to engage the supporting surface for the chair, and an upper end connected to the right side frame member 46. A shorter length for the left frame member 44 is required to allow left frame member 44 to fit underneath right frame member (see FIGS. 8 and 9), when a pair of left side legs of one chair are fit underneath the pair of right side legs of another similar configured ganged chair in a leg-over-leg position (see FIG. 6). The first, or left, connector member 44, and second, or right, connector member 46 are disposed inwardly of the lower frame left side 40 and right side 42 respectively, whereby the upper ends of each of the leg members which are connected to a respective connector member are disposed outwardly of the respective frame connector member 44, 46.

Each respective chair leg can be circular oval, rectangular, or other cross-sectional shape, with a forward facing and rearward facing, generally surface on each leg. In the depicted embodiment, left front leg 48 includes an upper, forward facing, outer flat surface 56, and an opposed upper, inward flat surface 56', with the upper forward surface 56 having an elongated slot 58 positioned in the upper end of leg 48 (see FIG. 5). Rear left leg 50 includes an upper, rearward facing, outer flat surface 60, and an opposed upper, inward flat surface 60', with the upper rearward surface 60 having an elongated slot 62 positioned in the upper end of leg 50. In one embodiment, each slot is approximately 1½ inch in length and each slot 58, 62 is open outwardly from the appropriate surface of each left leg, extending from the crown of surfaces 56 and 60 of each left leg member, downward along a portion of the length dimension of the appropriate surface of each left leg member (see FIGS. 2, 3, and 5). Each slot 58, 62 is aligned on each respective upper surface so that lugs 66, 70 (described below) can fit in and downward into each respective slot when the right side legs of one ganged chair are placed over the left side legs of a like chair in a leg-over-leg, side-by-side relationship for the respective upper and lower frames of the chairs.

In a suitable embodiment, the left upper distance L from the forward facing flat surface 56 of the left front leg 48, to the rearward facing flat surface 60 of the rear left leg 50 of each chair, is about 6½ to about 8 inches, with one embodiment sized at about 7½ to about 7¾ inches, but distance L may be varied as the sizing of the chair frame 12 varies. An additional important element of the present invention is that the left upper distance L is less than the right upper distance R between the rearward facing flat surface 64 of the right front leg 52, and the forward facing flat surface 68 of the right rear leg 54, allowing the spaced apart distance between the left legs to be less than the spaced apart distance between the right legs. The front pair of legs 48, 52, identified as first and third leg members, are inclined at a selected angle forward relative to a vertical line extending downward from front cross-member 72. The angle forward allows front legs to be stacked over other like chairs.

Figure 5:
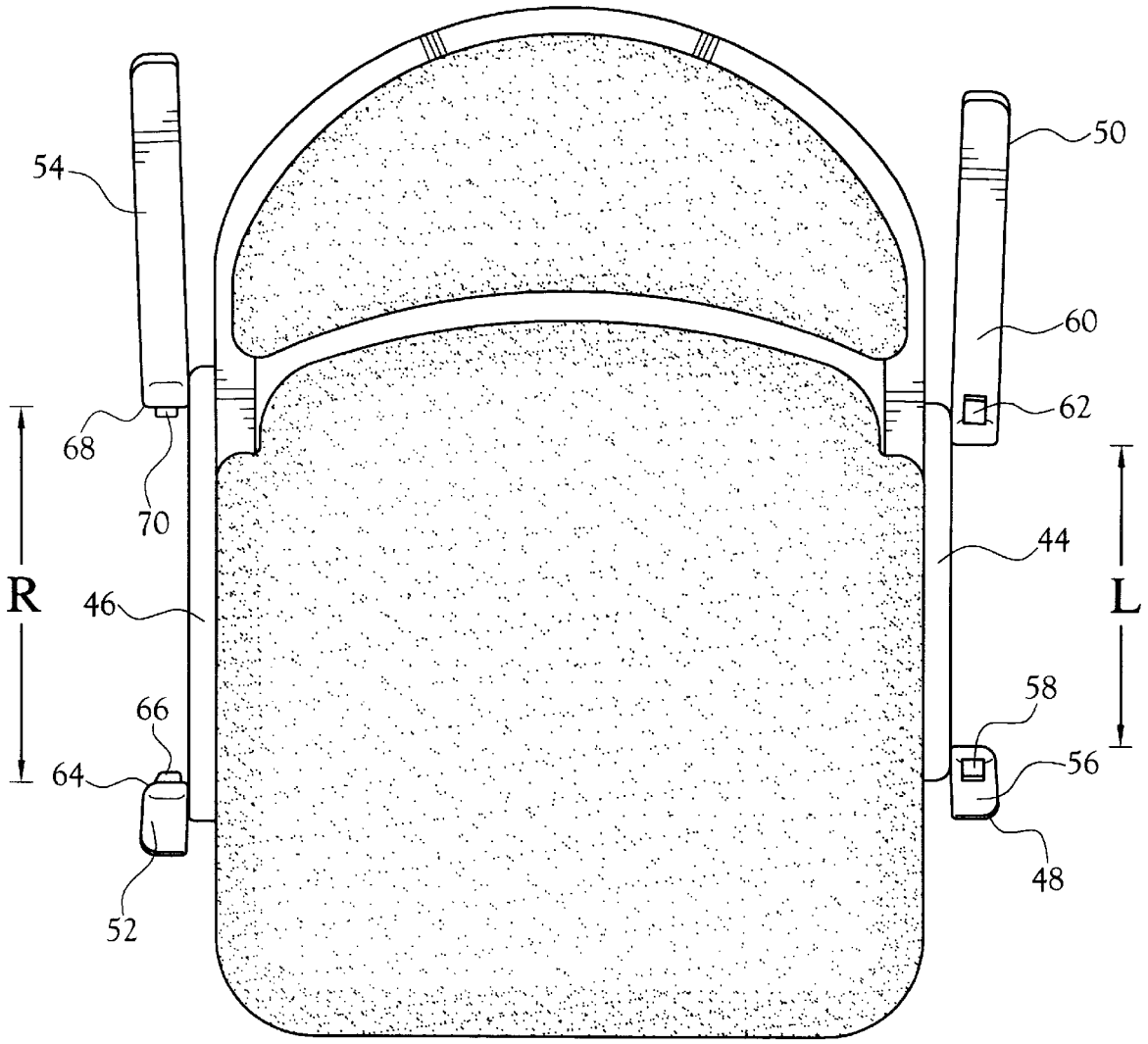
FIG. 5 is a top view of the ganging chair of FIG. 1 illustrating the positioning of elongated slots on the upper portions of the left chair legs, and the positioning of elongated lugs on the upper portions of the right chair legs.

Referring to FIG. 5, the third or right front leg 52 of each chair includes a rearward facing flat surface 64, and opposed forward flat surface 64', with the surface 64 having an elongated protrusion or lug 66 member that protrudes rearward. The fourth or right rear leg 54 includes a forward facing flat surface 68, and opposed rearward facing flat surface 68', with the surface 68 having an elongated protrusion or lug 70 member that protrudes frontward. Each lug begins approximately a fraction of an inch below the upper end of each surface 64,68 of each respective right leg member, and each lug extends along a portion of the length dimension of the upper end of the inward facing surfaces 64, 68 of the right leg members. Each lug 66, 70 are approximately half of the length of each of the slots 58, 62, allowing some free play of each lug 66, 70 within in the respective slots 58, 62 when right side legs 52, 54 are placed over and down onto left side legs 48, 50.

Figure 6:
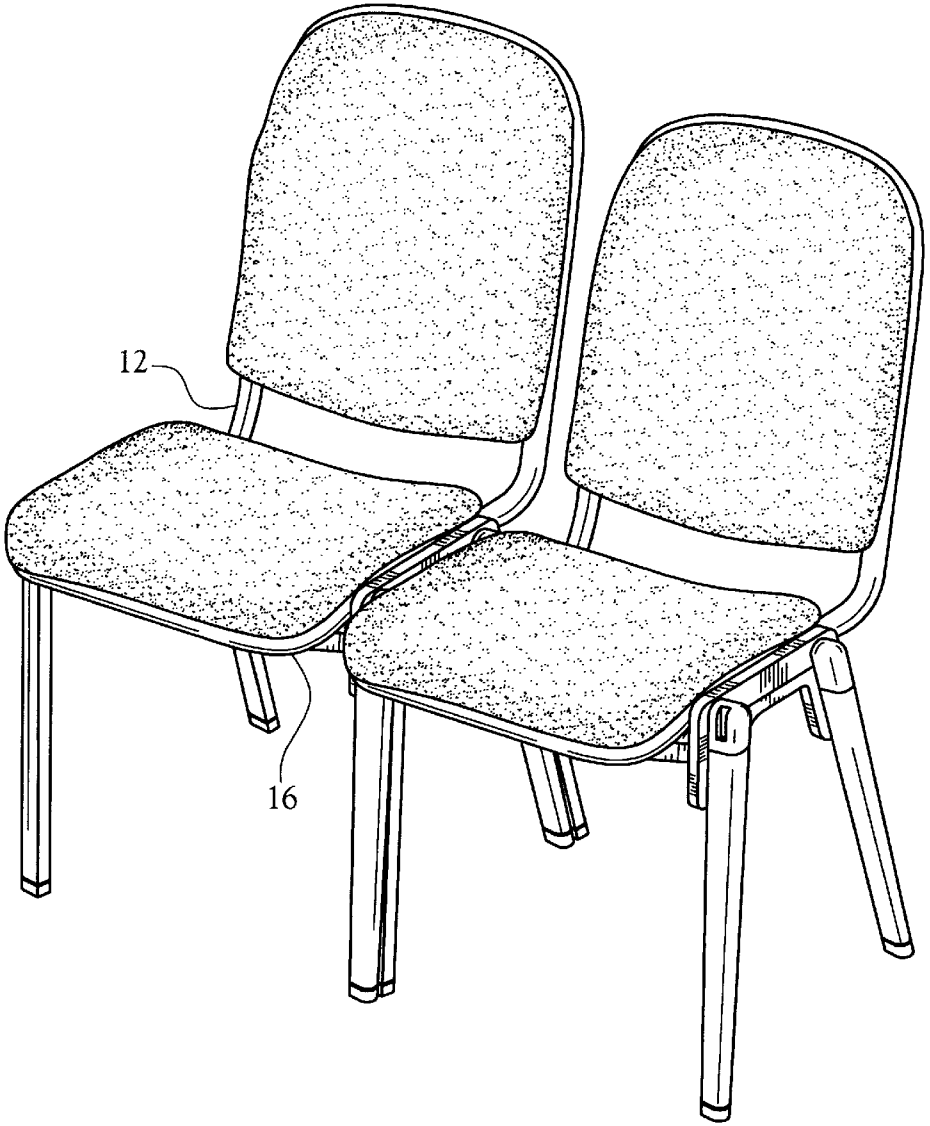
FIG. 6 is a perspective view of two ganging chairs in accordance with the present invention connected side-to-side, illustrating the right leg of one chair placed over the left leg of a second chair configuration when chairs are horizontally aligned.
Figure 7A:
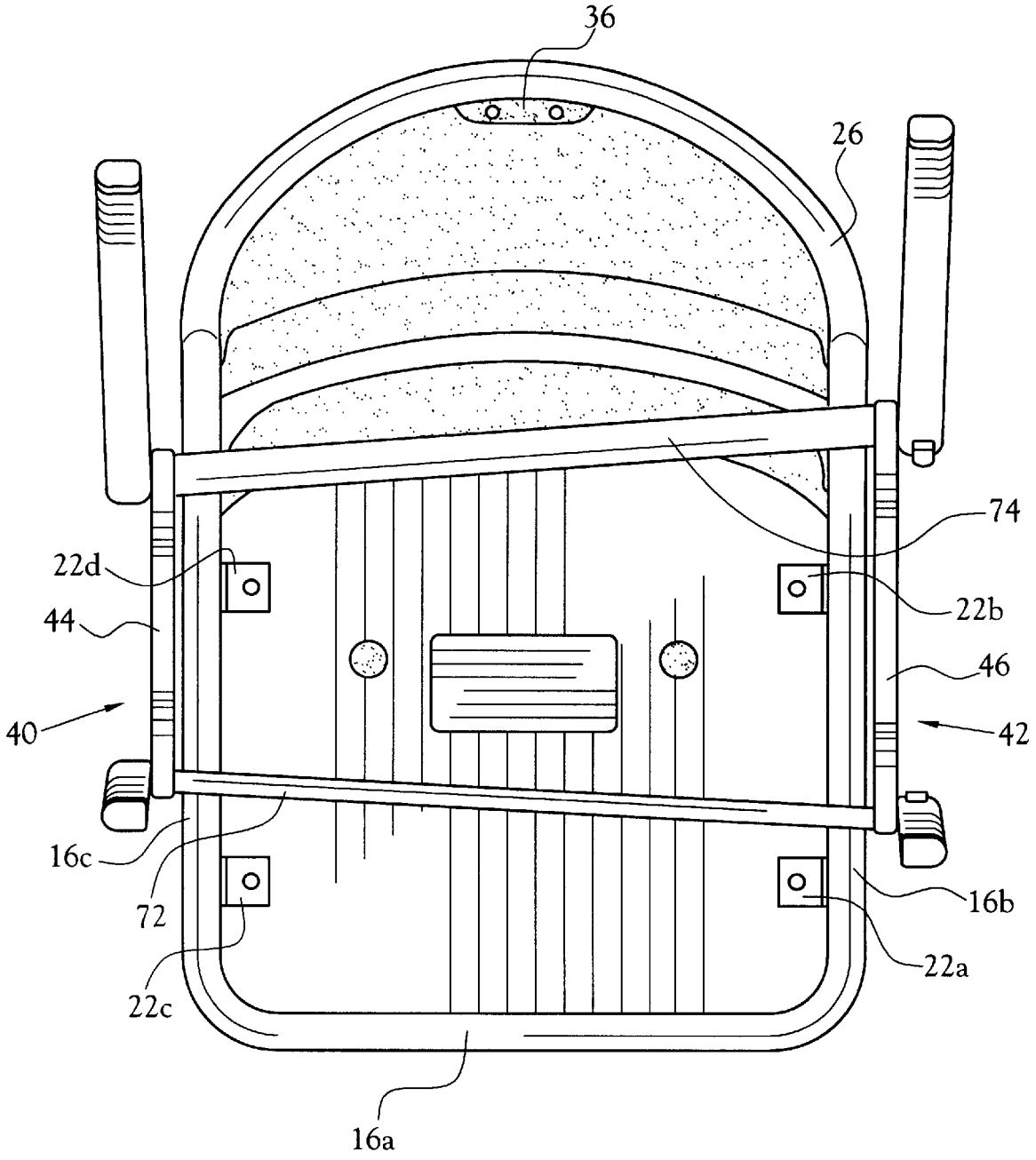
FIG. 7*a* is an underneath view of one embodiment of the converging front cross-member and rear cross-member of a ganging chair in accordance with the present invention, illustrating the shorter length of the left side frame member, and an upper bracket of the backrest of the ganging chair.
Figure 7B:
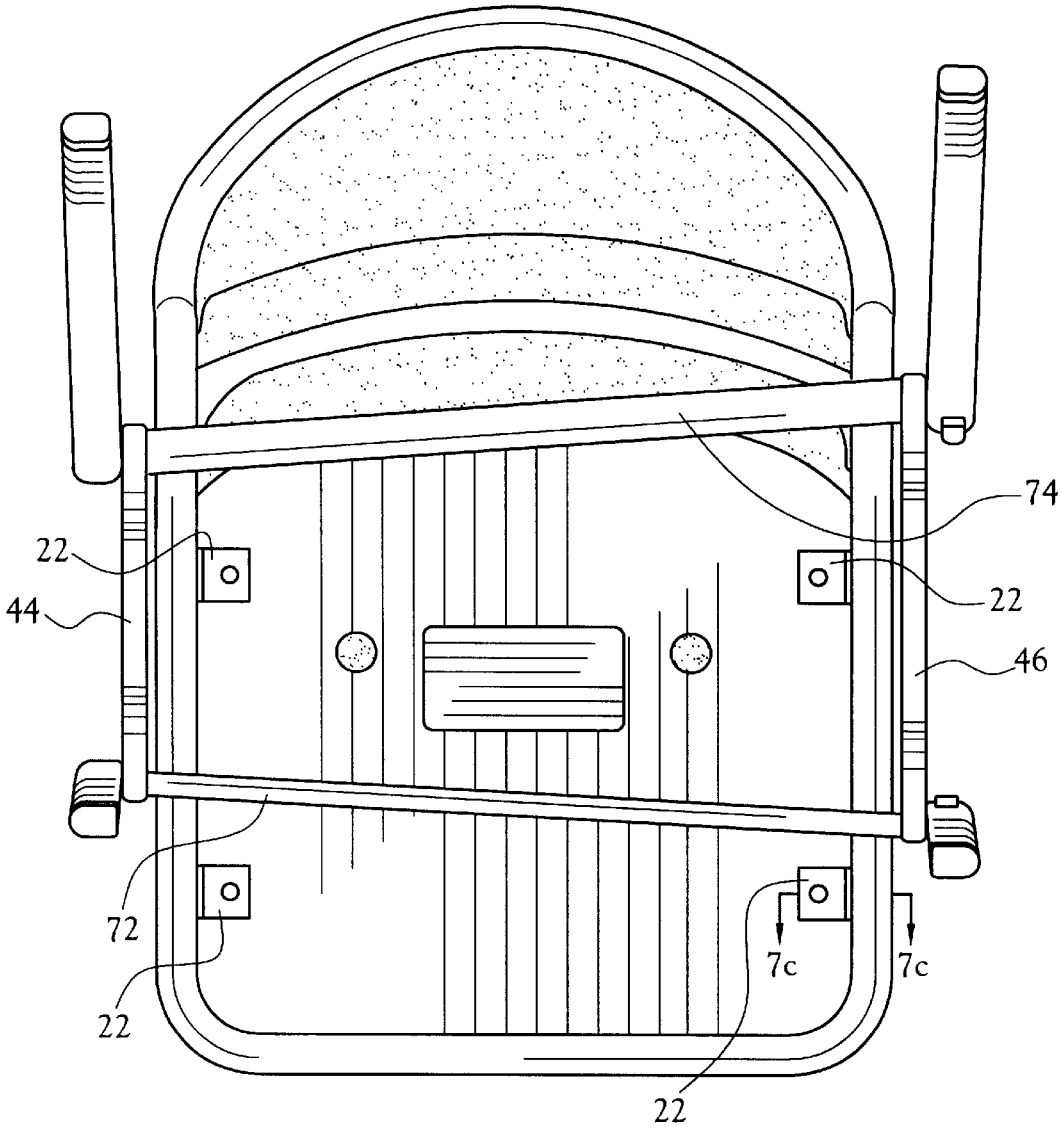
FIG. 7*b* is an underneath view of another embodiment of the converging front cross-member and rear cross-member of FIG. 7*a,* illustrating the shorter length of the left side frame member, without an upper bracket of the backrest of the ganging chair.
Figure 7C:
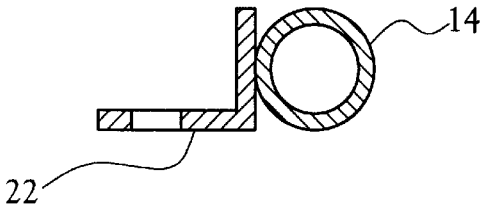
FIG. 7*c* is a cross section taken generally along line 7*c*—7*c*', of FIG. 7*b,* illustrating the tubular shape of the upper frame and the connector bracket underneath the upper frame.

To allow the proper function of the leg-over-leg ganged chair of the present invention, the right upper distance R between surface 64 and surface 68 is greater than the left upper distance L between the surface 56 and surface 60 (see FIG. 5), to allow lugs 66 and 70 of the right side to fit respectively into slots 58 and 62 of the left side, when right side legs of one chair are placed over the left side legs of another similar configured ganged chair in a leg-over-leg position (see FIG. 6).

The rear pair of chair legs 50, 54, also identified as second leg member and fourth leg member, are inclined at a selected angle backward relative to a vertical line extending downward from the rear cross-member 74. The rear legs 50, 54 are about ½ inch to about 1 inch longer than the front legs 48, 52 to facilitate a pair of left side legs of one chair to fit underneath the pair of right side legs of another similar configured ganged chair in a leg-over-leg position (see FIG. 6). Having longer rear legs and a selected angle of the rear pair of legs that is different than the selected angle of the front pair of legs, allow the left side legs and both of the covering right side legs to reach the supporting surface, so that all four legs of each chair are weight-supporting on the supporting surface for the ganged chairs, such as a meeting room floor or stage floor.

Structural rigidity of the chair frame 12 and front pair of legs 48, 52, and rear pair of legs 50, 54, may be increased by a front cross-member 72 that connects to and extends between a front inner surface of the left side frame member 44, to a front inner surface of the right side frame member 46, each side frame member being attached respectively between the left side legs and right side legs. A rear cross-member 74 is connected to and extends between a rear inner surface of the left side frame member 44, to a rear inner surface of the right side frame member 46. The left side frame member 44 is of a shorter length than the right side frame member 46, so that the front cross-member 72 slants rearward as it traverses underneath the seat platform 18 from the front inner surface of the right side frame member 46, to the front inner surface of the left side frame member 44. The rear cross-member 74 slants frontward as it traverses underneath the seat platform 18 from the rear inner surface of the right side frame member 46, to the rear inner surface of the left side frame member 44. An alternative description is that front cross-member 72 and rear cross-member 74 are not parallel to each other, and are not parallel respectively to the front 16*a* base portion. The width between the front cross-member 72 and rear cross-member 74 decreases as the cross-members extend from the right side frame member 46 to the left side frame member 44. The left legs attached to the left side frame member 44 are closer together than the right side legs.

The orientation of the front cross-member 72 and rear cross-member 74, and the inclined angles of the front pair of chair legs (frontward), and the rear pair of chair legs (rearward), allow the right side legs 52, 54 of one chair frame 12 to be placed over the left side legs 48, 52 of another chair frame of similar design, in a leg-over-leg configuration (FIG. 6). An alternative description is when the chair frame 12 is oriented side-by-side with other frames of similar design in a ganged or horizontally oriented seating arrangement, the left side legs 48, 50 of a first chair frame 12 are positionable underneath the right side legs 52, 54 of a second chair frame. The orientation of the left side legs 48, 50 underneath the right side legs 52, 54 of a second chair forms a single width leg unit on either side of the ganged chairs, reducing the overall width of a plurality of the ganged chairs.

An important element for the proper functioning of the invention is that left frame member 44 is shorter than the right frame member 46, by about 1½ inches at the upper portion of each frame member. Left frame member 44 can be between about 7 to about 9 inches long at the upper portion of the frame member connecting to the upper portions of the appropriate left legs, with one embodiment sized at about 8 inches long. The right frame member 46 can be about 7½ to about 10½ inches in length at the upper portion of the frame member connecting to the upper portions of the appropriate right legs, with one embodiment sized at about 9½ inches in length.

Figure 11:
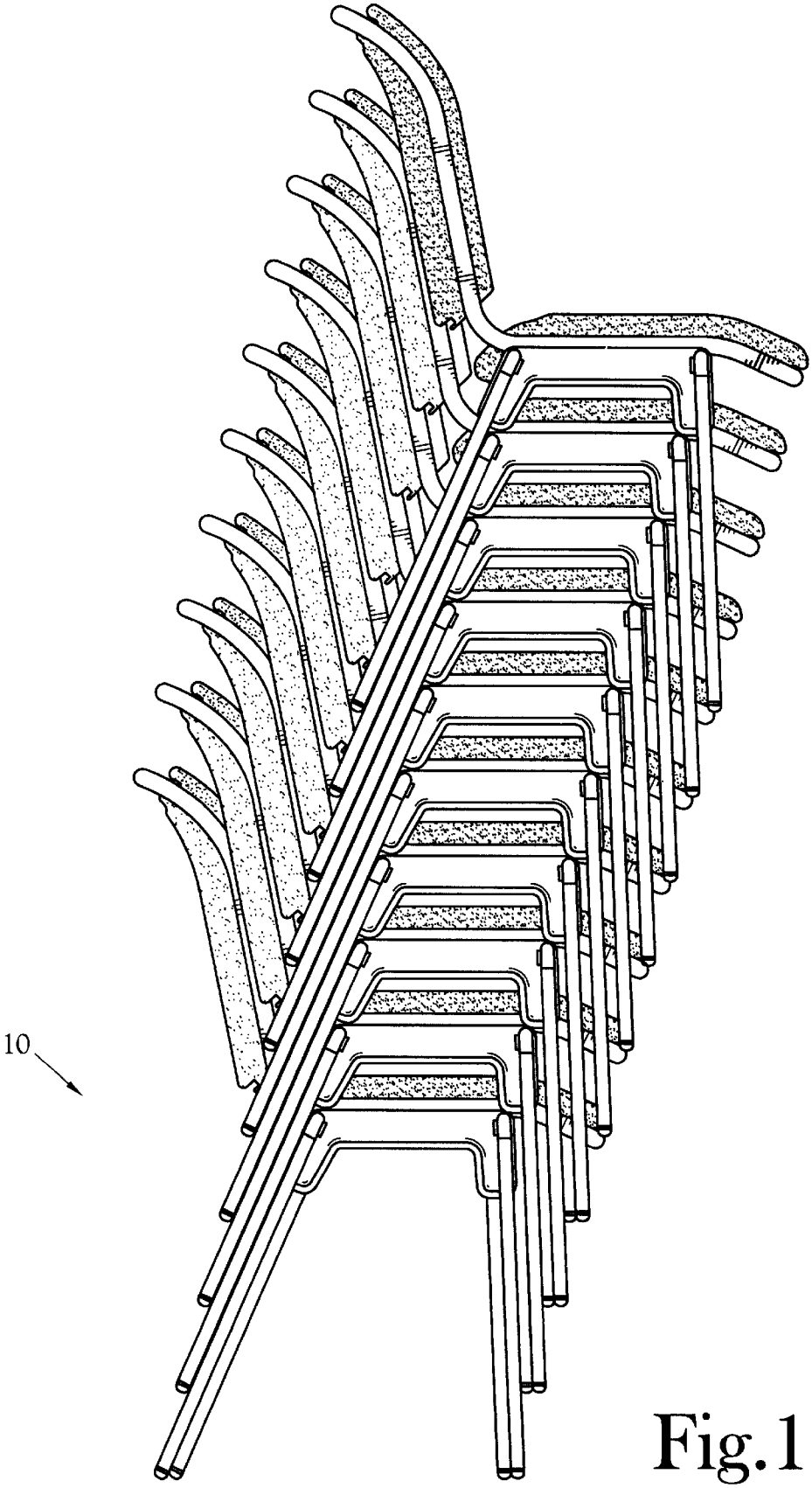
FIG. 11 is a right side view of a plurality of ganging chairs of the present invention stacked vertical.

The leg-over-leg positioning provides several advantages over the prior configurations of side-by-side seating. The side-by-side positioning of a plurality of chair frames 12 in an integral ganged set of chairs enables grouping of a larger number of chairs in a row across a set width of floor space, providing increased seating capacity for a limited width of seating (FIG. 11). Also, the orientation of the left legs of each chair positioned underneath the right legs of adjacent chairs provides a fool-proof setup of chairs in a time-efficient manner.

Figure 8:
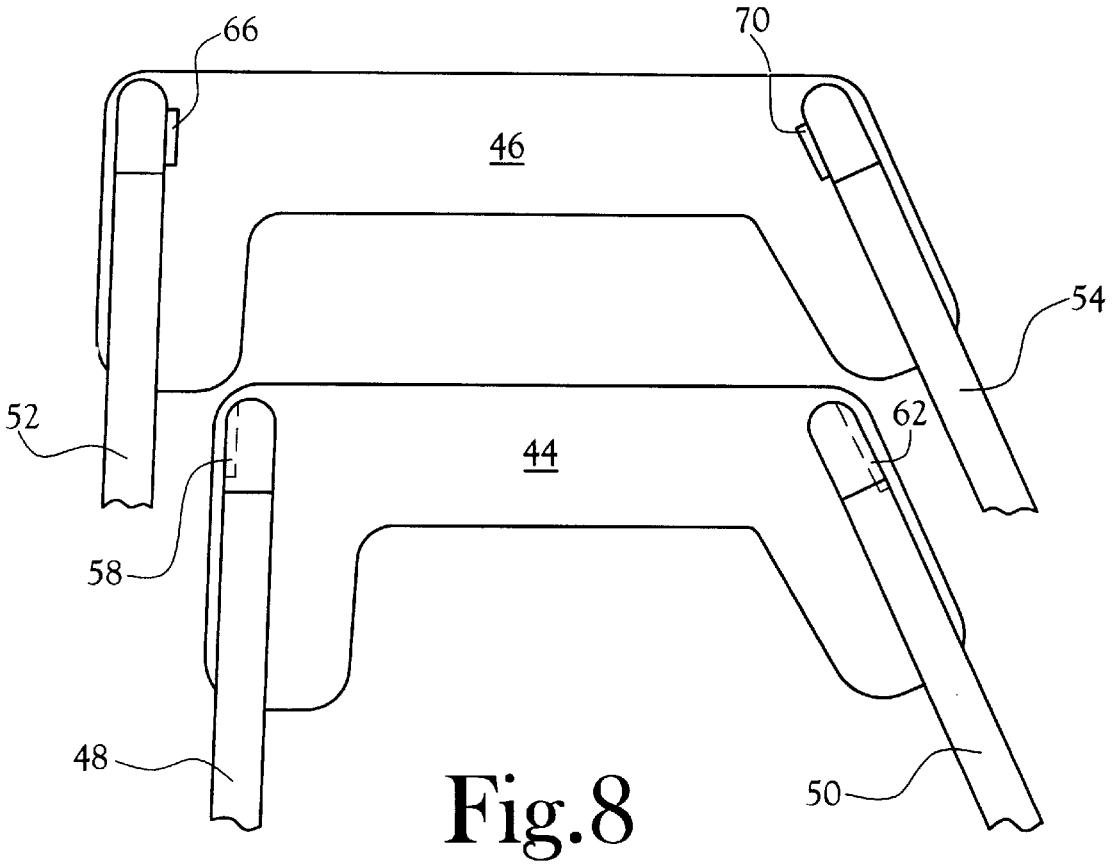
FIG. 8 is a detailed side view of the placement of the elongated lugs of the right side legs into the elongated slots of the left side legs as a set of right chair legs of a first chair are placed over the left chair legs of an adjacent ganging chair.
Figure 9:
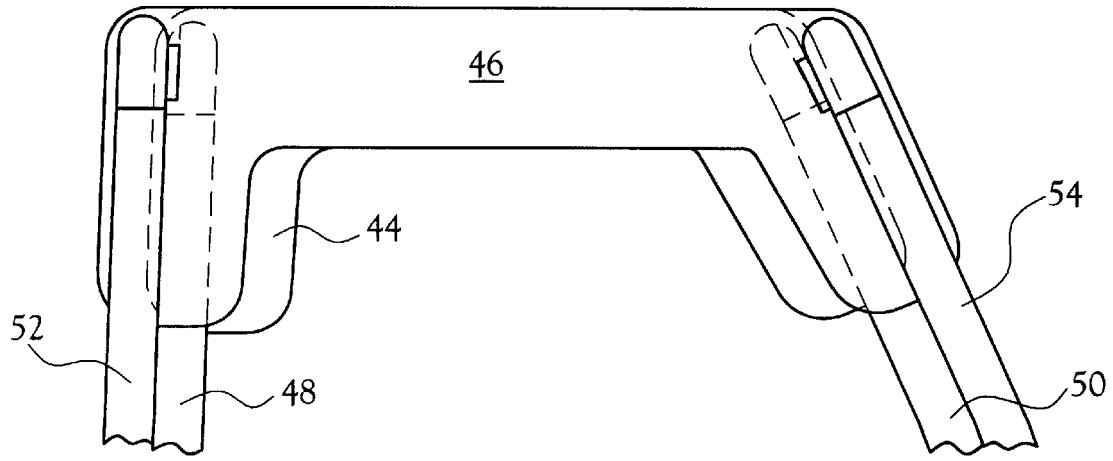
FIG. 9 is a side view of the lugs fitting into slots of the respective legs depicted in FIG. 8.
Figure 10:
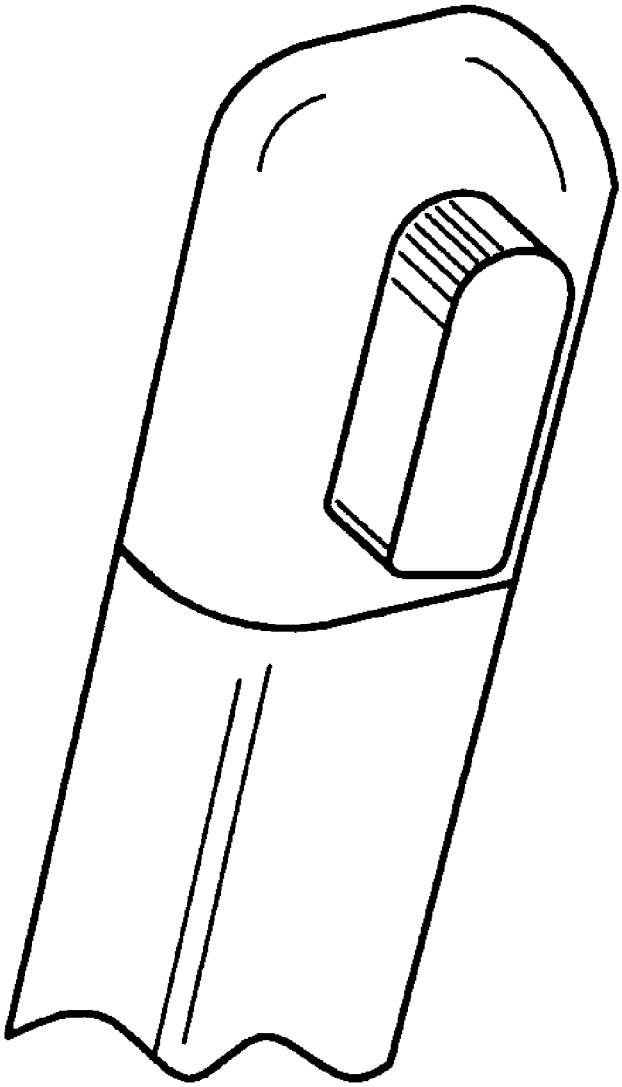
FIG. 10 is a perspective view of typical lug of the right chair legs of a ganging chair of the present invention.
Figure 12:
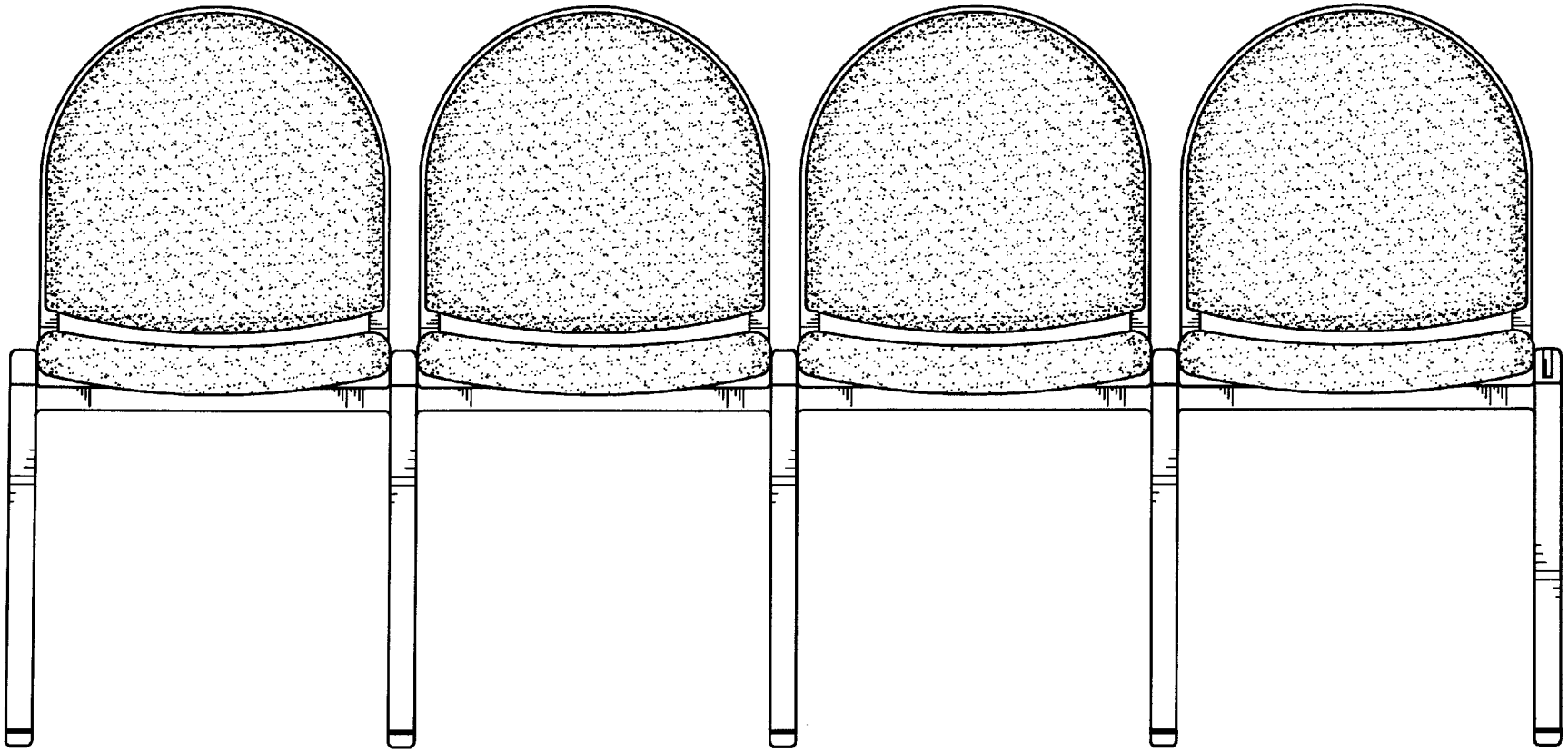
FIG. 12 is a front view of a plurality of ganging chairs of the present invention oriented side-by-side and leg-over-leg as an interconnected group of chair frames.

The width and fit of the lugs 66, 70 of the right leg into elongated slots 58, 62 having a similar width of the left legs, provides an anti-rotation and locking mechanism for each chair 10 when positioned in a side-by-side, leg-over-leg position with a plurality of chair frames 12 (see FIG. 12). The locking mechanism utilizes the elongated slots 58, 62 of the left legs to accept, respectively, the lugs 66, 70 of the right leg (FIG. 8). The interlocking of the lugs on the right side legs of one ganged chair, into the slots of the upper surfaces of the left side legs of a like chair, along with right legs oriented over adjacent left legs of a plurality of the chair frames 12, provides additional structural integrity of the leg-over-leg ganged chairs 10. The positioning of the left side frame member 44 and the right side frame member 46 on the respective outer surfaces of the left side 16*c* and right side 16*b* of the base portion 16 provides ease of stacking of a plurality of chairs in an approximately vertical stack of chair frames 12. In addition, the positioning of the left side frame member 44 and the right side frame member 46 flush with, or lower than the upper surface of the respective outer surfaces of the base portion 16, minimizes the potential of contact between a seated person's clothing or elbows with the blunt corners of the upper surfaces of each of the legs 48, 50, 52, 54.

The above described chair frame 12 having a left side frame member 44 of a shorter length than a right side frame member 46, can provide similar beneficial uses of vertical stacking and side-by side, leg over leg, ganged positioning of chairs in compact configurations if the base portion 16 of the chair frame 12 is constructed in a reverse configuration with a right side frame member 46 having a shorter length than the left side frame member 44 (not shown). In the reverse or alternative configuration, the associated front cross-member 72 and rear cross-member 74 would converge from a greater separation width on the left side 40 of the base portion 16, to a lesser separation width on the right side 42 of the base portion 16, which provides the capability of the right legs 52, 54 to fit under the left legs 48, 50 of an adjacent chair frame 12.

An additional configuration is to incorporate an alternative interlocking system on the upper portions of each chair leg, consisting of male/female connections, or "v" shaped lugs on the upper portions of one side of chair legs, and similar shaped slots or channels on an opposing side of chair legs, as recognizable by one skilled in the art. Appropriately shaped "v" slots can be positioned on the pair of legs on the first side of a ganged chair, in positions to accept, respectively, the "v" shaped lugs on the pair of legs on the opposing, or second side of a like ganged chair (not shown).

While a preferred embodiment is shown and described, it will be understood that it is not intended to limit the disclosure, but rather it is intended to cover all modifications and alternate methods falling within the spirit and the scope of the invention as defined in the appended claims. One skilled in the art will recognize variations and associated alternative embodiments. The foregoing description is exemplary in nature and the spirit and scope of the appended claims should not be limited to the description of the embodiment of the invention contained herein.

What is claimed is:

1. A leg-over-leg stackable chair that is capable of being ganged with a further like chair in side-by-side relationship, comprising:

an upper frame adapted to receive and support a seating platform and a backrest for supporting a user seated in the chair, a lower frame having first and second sides supporting said upper frame above a supporting surface for the chair, said lower frame including first and second leg members disposed on said first side of said lower frame, and third and fourth leg members disposed on said second side of said lower frame, each of said leg members having a lower end adapted to engage the supporting surface for the chair, and an upper end, a first connector member extending between and fixedly interconnecting said upper ends of said first and second leg members to one another, a second connector member extending between and fixedly interconnecting said upper ends of said third and fourth leg members to one another, said first and second connector members being disposed inwardly of said lower frame whereby said upper ends of each of said leg members which are connected to a respective connector member are disposed outwardly of said respective connector member, said first connector member being shorter in length than said second connector member whereby the upper ends of said first and second leg members are disposed apart from one another by a distance smaller than the spaced apart distance of said upper ends of said third and fourth leg members, whereby the first and second leg members of a first chair will receive thereon in leg-over-leg relationship, corresponding third and fourth leg members of a further like chair for stacking of the first and further like chairs, each of said upper ends of said first and second leg members having respective outer surfaces and a slot defined in each of said outer surfaces, each of said slots extending along a portion of the length dimension of its respective leg member, one end of each of said slots opening outwardly of said upper end of its respective leg member, each of said upper ends of said third and fourth leg members having respective inner surfaces which face one another, an elongated lug member projecting from said inner surface of said third leg member and an elongated lug member projecting from said inner surface of said fourth leg member, said lugs facing one another across the space between said upper ends of said third and fourth leg members, the length dimension of each of said lug members extending along a portion of the length dimension of its respective leg member, whereby said lugs of said third and fourth leg members of a first chair are received within respective slots of said first and second leg members of a further chair when said first and second leg members of the further chair are disposed in leg-over-leg relationship under said third and fourth leg members of the first chair to secure the first and further like chairs in ganged side-by-side relationship.

2. The leg-over-leg stackable chair of claim 1, wherein the lower ends of all of the leg members of the ganged chairs are in direct supporting engagement with a supporting surface for the chairs.

3. A stackable ganged chair that is capable of leg-over-leg orientation in a side-by-side relationship, comprising:

a chair frame having an upper frame and a lower frame, said upper frame adapted to receive and support a seating platform thereon, said upper frame having a front side, a first side and a second side, each of said first and second sides having rear ends attached to a backrest for supporting a user seated in the ganged chair, said lower frame having first and second sides supporting said upper frame above a supporting surface for the chair, said lower frame including left front and left rear leg members disposed on said first side of said lower frame, and right front and right rear leg members disposed on said second side of said lower frame, each of said leg members having a lower end adapted to engage the supporting surface for the chair, and each of said leg members having an upper end, each of said upper ends of said left front and left rear leg members having respective outer surfaces and a slot defined in each of said outer surfaces, each of said slots extending along a portion of the length dimension of its respective leg member, one end of each of said slots opening outwardly of said upper end of its respective leg member, each of said upper ends of said right front and right rear leg members having respective inner surfaces which face one another, an elongated lug member projecting from said inner surface of said right front member, and an elongated lug member projecting from said inner surface of said right rear leg member, said lugs facing one another across the space between said upper ends of said right front and said right rear leg members, the length dimension of each of said lug members extending along a portion of the length dimension of its respective leg member, whereby said lugs of said right front and said right rear leg members of a first chair are received within respective ones of said slots of said left front and left rear leg members of a further chair when said left front and left rear leg members of the further chair are disposed in leg-over-leg relationship under said right front and right rear leg members of the first chair to secure the first and further like chairs in ganged side-by-side relationship, a left side connector member extending between and fixedly interconnecting said upper ends of said left front and left rear leg members to one another, a right side connector member extending between and fixedly interconnecting said upper ends of said right front and right rear leg members to one another, said left side and right side connector members being disposed inwardly of said lower frame whereby said upper ends of each of said leg members which are connected to a respective connector member are disposed outwardly of said respective connector member, and said left side connector member being shorter in length than said right side connector member, whereby the upper ends of said right front and right rear leg members are disposed apart from one another by a distance greater than the spaced apart distance of said upper ends of said left front and left rear leg members, whereby the left front and left rear leg members of a first chair will receive thereon in leg-over-leg relationship, corresponding right front and right rear leg members of a further like chair for stacking of the first and further like chairs.

4. The stackable ganged chair of claim 3, wherein said leg members further comprise:

said left front and said right front leg members are inclined at an angle forward relative to a vertical line extending downward from said front side of said upper frame, and said left rear leg member and said right rear leg member are inclined at an angle backward relative to a vertical line extending downward from said rear ends of said first and second sides.

5. The stackable ganged chair of claim 4, wherein said angle forward of said left front leg member is substantially equal to but not greater than said angle forward of said right front leg member, and said angle backward of said left rear leg member is substantially equal to but not greater than said angle backward of said right rear leg member.

6. The stackable ganged chair of claim 5, wherein said upper frame further comprises a substantially horizontal portion supporting said seating platform, said upper frame includes a back frame portion extending upwardly and rearwardly from said seating platform, said back frame portion having a detachable backrest, an upper bracket, a lower pin connector, and a means of releasably mounting said upper bracket of said back frame to said backrest.

7. The stackable ganged chair of claim 6, wherein said means of releasably mounting comprises at least one connector releasably attachable through said upper bracket and into said detachable backrest.

8. The stackable ganged chair of claim 7, wherein said backrest further comprises an upper area and a lower area of said detachable backrest, said upper bracket of said back frame portion aligned with said upper area of said backrest, said lower area of said backrest having a lower surface with a plurality of holes therein, and said lower pin connector of said back frame portion having two inwardly positioned pins that extend upward from said back frame portion, said pins insert into said lower surface holes of said detachable backrest.

9. The stackable ganged chair of claim 8, wherein the lower ends of all of the leg members of the ganged chairs are in direct supporting engagement with a supporting surface for the chairs.

10. A stackable leg-over-leg chair that is capable of being ganged with a further like chair in side-by-side relationship, comprising:

an upper frame adapted to receive and support a seating platform, said seating platform supporting a seat attachable thereon;

a front side, a left side, and a right side of said upper frame, said left side and said right side having rear ends;

a back frame portion attached to said rear ends of said left side and said right side, said back frame portion extending upward from said upper frame, said back frame portion angled backward from the vertical position;

a lower frame having first and second sides supporting said upper frame above a supporting surface for the chair;

a left side frame member attached to an outer side of said first side of said lower frame, said left side frame member having a front left end and a rear left end;

a left front leg and a left rear leg, each having a portion of length of each left front leg and left rear leg adapted to engage corresponding legs of a further like chair in leg-over-leg relationship, and each leg having an upper end, said upper end of each left front and left rear leg connected to said respective front left end and said rear left end of said left side frame member;

a right side frame member attached to an outer side of said right side of said lower frame, said right side frame member having a front right end and a rear right end;

a right front leg and a right rear leg, each having a portion of length of each right front leg and right rear leg adapted to engage corresponding legs of a further like chair in leg-over-leg relationship, and each leg having an upper end, said upper end of each right front and right rear leg connected to said respective front right and said rear right end of said right side frame member;

said left front leg and said right front leg inclined at a forward angle relative to a vertical line extending downward from said front side of said upper frame;

said left rear leg and said right rear leg inclined at a rearward angle relative to a vertical line extending downward from said rear ends of said left side and said right side of said upper frame; and said left side frame member is shorter in length that said right side frame member, thereby said upper ends of said left front leg and said left rear leg are disposed apart from one another by a distance smaller than the spaced apart distance of said upper ends of said right front leg and said right rear leg, whereby the legs of a first chair will receive thereon in leg-over-leg relationship, corresponding legs of a further like chair for ganging of the first and further chairs;

whereby said upper frame and said lower frame with associated legs are stackable on top of the first and further like chairs.

11. The stackable leg-over-leg chair of claim 10, wherein said left front and left rear legs further comprise:

a front facing upper surface of said left front leg, said front facing upper surface having an elongated slot therein; and a rear facing upper surface of said left rear leg, said rear facing upper surface having an elongated slot therein, each of said slots extending along a portion of the length dimension of its respective leg, one end of each of said slots opening outwardly of said upper end of its respective leg;

whereby said upper surface of said left front leg and said upper surface of said left rear leg do not extend above the upper surface of left side tube of said base portion.

12. The stackable leg-over-leg chair of claim 11, wherein said right front and right rear legs further comprise:

a rear facing upper surface of said right front leg, said rear facing upper surface having an elongated lug thereon, said elongated lug shaped similar in length and width as said elongated slot of said front facing upper surface of said left front leg; and a front facing upper surface of said right rear leg, said front facing upper surface having an elongated lug thereon, said elongated lug shaped similar in length and width as said elongated slot of said rear facing upper surface of said left rear leg; and each of said lugs extending along a portion of the length dimension of its respective leg, one end of each of said lugs projecting downward along said upper end of its respective leg, said one downward projecting end of each end having a rounded end for directing said lug into said respective elongated slots;

whereby said elongated lug on said right front leg, and on said right rear leg fit respectively into said elongated slot in said left front leg and said elongated slot in said left rear leg when said right front and right rear legs of one stackable ganged chair are positioned over and onto the left front and left rear legs of a similar configured stackable ganged chair.

13. The stackable leg-over-leg chair of claim 12, wherein said forward angle of said left front leg is substantially equal to but not greater than said forward angle of said right front leg, and said backward angle of said left rear leg is substantially equal to but not greater than said backward angle of said right rear leg.

14. The stackable leg-over-leg chair of claim 13, wherein said back frame portion further comprises:

an upper back frame having a detachable backrest, an upper bracket, a lower pin connector, and a means of releasably mounting said upper bracket of said back frame to said detachable backrest; and a lower inside surface of said back frame having two inwardly positioned pins that extend upward from said inside surface, said pins insert into a lower end of said backrest, said backrest is attachable to said back frame by placement onto said pins and attachment of said means of releasably mounting through said upper back frame and into said backrest.

15. The stackable leg-over-leg chair of claim 14, wherein said seat includes a cushion pad removably attachable by a plurality of connectors to said seating platform, said cushion pad is replaceable by removal of said plurality of connectors.

16. The stackable leg-over-leg chair of claim 15, wherein the lower ends of all of the legs of the ganged chairs are in direct supporting engagement with a supporting surface for the chairs.

17. A leg-over-leg stackable chair that is capable of being ganged with a further like chair in side-by-side relationship, comprising:

an upper frame adapted to receive and support a seating platform and a backrest for supporting a user seated in the chair, a lower frame having first and second sides supporting said upper frame above a supporting surface for the chair, said lower frame including first and second leg members disposed on said first side of said lower frame, and third and fourth leg members disposed on said second side of said lower frame, each of said leg members having a lower end adapted to engage the supporting surface for the chair, and an upper end, a first connector member extending between and fixedly interconnecting said upper ends of said first and second leg members to one another, a second connector member extending between and fixedly interconnecting said upper ends of said third and fourth leg members to one another, said first and second connector members being disposed inwardly of said lower frame whereby said upper ends of each of said leg members which are connected to a respective connector member are disposed outwardly of said respective connector member, said first connector member being longer in length than said second connector member whereby the upper ends of said first and second leg members are disposed apart from one another by a distance larger than the spaced apart distance of said upper ends of said third and fourth leg members, whereby the first and second leg members of a first chair will be receivable thereon in leg-over-leg relationship, corresponding third and fourth leg members of a further like chair for stacking of the first and further like chairs, each of said upper ends of said third and fourth leg members having respective outer surfaces and a slot defined in each of said outer surfaces, each of said slots extending along a portion of the length dimension of its respective leg member, one end of each of said slots opening outwardly of said upper end of its respective leg member, each of said upper ends of said first and second leg members having respective inner surfaces which face one another, an elongated lug member projecting from said inner surface of said first leg member and an elongated lug member projecting from said inner surface of said second leg member, said lugs facing one another across the space between said upper ends of said first and second leg members, the length dimension of each of said lug members extending along a portion of the length dimension of its respective leg member, whereby said lugs of said first and second leg members of a first chair are received within respective slots of said third and fourth leg members of a further chair when said first and second leg members of the further chair are disposed in leg-over-leg relationship over said third and fourth leg members of the first chair to secure the first and further like chairs in ganged side-by-side relationship.

18. The leg-over-leg stackable chair of claim 17, wherein the lower ends of all of the leg members of the ganged chairs are in direct supporting engagement with a supporting surface for the chairs.

19. The leg-over-leg stackable chair of claim 17, wherein said elongated lug member further comprising a v-shaped lug member projecting from said inner surface of said first leg member and a v-shaped lug member projecting from said inner surface of said second leg member, each of said v-shaped lug members having a pointed end projecting downwardly along said inner surfaces of said leg members.

20. The leg-over-leg stackable chair of claim 17, wherein said slot further comprising a v-shaped slot on said outer surfaces of said upper ends of said third and fourth leg members, each of said slots extending along a portion of the length dimension of its respective leg member, each of said slots having a pointed end projecting downwardly along said outer surfaces of said leg members.

* * * * *